US005801485A

United States Patent [19]

Van Veen et al.

[11] Patent Number: 5,801,485

[45] Date of Patent: Sep. 1, 1998

[54] DISPLAY DEVICE

[75] Inventors: Gerardus N. A. Van Veen; Remko Horne; Dirk W. Harberts; Siebe T. De Zwart, all of Eindhoven, Netherlands

[73] Assignee: U.S. Philips Corporation, New York, N.Y.

[21] Appl. No.: 492,827

[22] Filed: Jun. 20, 1995

[30] Foreign Application Priority Data

Jun. 30, 1994 [EP] European Pat. Off. ..... 94201887

[51] Int. Cl.[6] ..... H01J 31/12

[52] U.S. Cl. ..... 313/495; 313/422; 313/497; 313/308

[58] Field of Search ..... 313/495, 496, 313/497, 422, 336, 309, 306, 310

[56] References Cited

U.S. PATENT DOCUMENTS

| | | | |
|---|---|---|---|
| 3,812,559 | 5/1974 | Spindt et al. | 29/25.18 |
| 3,814,968 | 6/1974 | Nathanson et al. | 313/351 X |
| 3,855,499 | 12/1974 | Yamada et al. | 313/351 X |
| 3,935,500 | 1/1976 | Oess et al. | 313/495 |
| 4,303,930 | 12/1981 | Van Gorkom et al. | 357/13 |
| 4,818,914 | 4/1989 | Bodie | 313/351 X |
| 5,015,912 | 5/1991 | Spindt et al. | 313/495 |
| 5,153,483 | 10/1992 | Kishino et al. | 315/3 |

*Primary Examiner*—Ashok Patel
*Attorney, Agent, or Firm*—Robert J. Kraus

[57] ABSTRACT

In, for example a field emission display, the invention provides the possibility of combining a plurality of sub-substrates that are attached to a larger rear wall, because notably different modes of multiplexing provide a wider positioning tolerance of a sub-substrate with respect to the front plate. Moreover, the different multiplexing techniques lead to a smaller number of connections, even if no use is made of a rear wall supporting sub-substrates. A plurality of multiplexing techniques provides the possibility of activating a substantially equally large number of pixels of different colors during parts of an image period, so that there is substantially no color flicker.

9 Claims, 6 Drawing Sheets

DISPLAY DEVICE

BACKGROUND OF THE INVENTION

The invention relates to a display device comprising a first substrate which is provided with electron-generating means for generating electron beams towards a second substrate which is parallel to the first substrate and is provided with fluorescent means.

Display devices of this type are used, for example in monitors or in video apparatus at places where a cathode ray tube is not very well usable.

The first substrate may be a glass substrate provided with, for example field emitters as electron-generating means, but also, for example a silicon substrate in which field emitters or, for example cold cathodes based on avalanche multiplication (pn emitters) are realised as electron-generating means. Examples of field emitters and their manufacture are given in U.S. Pat. No. 3,812,559, while a description of pn emitters can be found in U.S. Pat. No. 4,303,930. A "diamond" emitter may be used alternatively.

The second substrate usually comprises phosphors as fluorescent means which are patterned and towards which the electrons are accelerated.

Notably when larger display devices are manufactured, various problems present themselves. When electrons from a given electron-generating area (which may be a single cathode or a group of emitters) are applied to each phosphor area on the second substrate, these areas must be aligned very accurately with respect to each other. Moreover, the substrates on which the pattern of these electron-generating areas are realised are usually restricted to maximum dimensions, for example because the diameter is restricted to, for example 15 cm for glass plates on which a field emitter matrix is realised, or to approximately 5 cm for semiconductor substrates in which cold cathodes are realised so as to obtain a satisfactory yield.

A second problem which may present itself is that electrons which land on the phosphor area are elastically scattered and impinge upon an adjacent area which emits light of a different colour. This gives rise to colour contamination.

SUMMARY OF THE INVENTION

It is, inter alia an object of the invention to obviate one or more of said problems.

To this end, a display device according to the invention is characterized in that the first substrate consists of sub-substrates.

The invention is based on the recognition that different types of measures render the registering of the phosphor areas with respect to the electron-generating areas less stringent than in the known device.

To achieve this, a first embodiment of a display device according to the invention is characterized in that a selection plate is arranged between the substrates, which selection plate has apertures tapering towards the side of the second substrate, the inner sides of said apertures being provided at the side of the second substrate with metallization patterns which extend across the surface of the selection plate at the side of the second substrate.

Each aperture corresponds to a phosphor area; since the plate can be mounted close to the second substrate, a substantially 1:1 relation is obtained between the apertures and the phosphor areas.

A preferred embodiment is characterized in that at least a glass plate having apertures whose diameter is substantially equal to that of the apertures in the selection plate at the side of the second substrate is arranged between the selection plate and the second substrate. Consequently, the energy of the electrons may be further increased, while the glass plate (or plates) also serves as a spacer and guarantees a satisfactory alignment. The walls of this "post-acceleration spacer" may be coated with an insulating or very high-ohmic coating so that the secondary electron efficiency is substantially 1. The alignment with respect to the first substrate is less critical than in conventional devices because it is determined via voltages on the metallization patterns towards which apertures (hence which phosphor areas) the electrons are accelerated. Since the electrons impinge upon the phosphor area after they have passed the selection plate, and elastically scattered electrons remain in the apertures, there is substantially no colour contamination.

Electrons from an electron-generating area are now used for different apertures by means of multiplexing. As stated, this renders the alignment less critical than in known devices so that sub-substrates can be combined to make a large substrate in a simpler manner.

Moreover, the number of connections is reduced. The same applies when other multiplexing modes are used. For example, a second embodiment of a display device according to the invention is characterized in that the electron-generating means comprise emitters and the first substrate is further provided with gate electrodes, the display device comprising means for selectively driving groups of gate electrodes via acceleration voltages.

A further embodiment is characterized in that the display device comprises means for selectively applying voltages to the conductor patterns which are connected to the fluorescent means in an electrically conducting manner.

Since the groups of gate electrodes and the conductor patterns connected to the fluorescent means in an electrically conducting manner can be selectively provided with voltages, multiplexing is again possible, while one electron-generating source can supply the electrons for a plurality of phosphor areas, so that the problem of mislanding can be reduced, notably along the edges of the sub-substrates. A combination of the measures is alternatively possible.

A plurality of multiplexing methods as described hereinafter have the additional advantage that within a sub-image substantially equal numbers of pixels of different colours are activated so that there is substantially no colour flicker.

An embodiment of a display device in which a plurality of sub-substrates is combined is characterized in that the side of the device remote from the second substrate has a rear wall spaced apart from the first substrate.

The extra space between the substrate and the rear wall may be adapted, for example to accommodate auxiliary functions such as, for example drive electronics, but a getter may alternatively be accommodated in this space.

If the fluorescent areas (phosphors) are activated by means of multiplexing, there will be various possibilities for the phosphor patterns. For example, the fluorescent means may comprise strips of a fluorescent material, while, viewed in a direction perpendicular to the substrates, electron-generating means are situated between strips of fluorescent material associated with successive pairs.

Alternatively, the fluorescent means may comprise interdigital fluorescent material patterns which are interconnected in an electrically conducting manner, while, viewed in a direction perpendicular to the substrates, electron-generating means are situated between fluorescent material interdigital patterns (meshing chamber structures) associated with successive pairs.

A further embodiment is characterized in that the fluorescent means comprise patterns, interconnected in an electrically conducting manner, of fluorescent material areas arranged in a row, said areas being mutually offset by half a pitch, while, viewed in a direction perpendicular to the substrates, electron-generating means are situated between rows associated with successive groups of four rows of fluorescent areas between the fluorescent areas of the central two rows associated with a group of four rows.

These and other configurations of the fluorescent means to be further described provide various multiplexing modes.

BRIEF DESCRIPTION OF THE DRAWINGS

These and other aspects of the invention will be apparent from and elucidated with reference to the embodiments described hereinafter.

In the drawing:

FIGS. 6 and 7 show diagrammatically a partial front elevational view and a front elevational view of a display device according to the invention; while

The Figures are diagrammatic and not to scale; corresponding parts are generally denoted by the same reference numerals.

DESCRIPTION OF THE PREFERRED EMBODIMENTS

Figure 1:
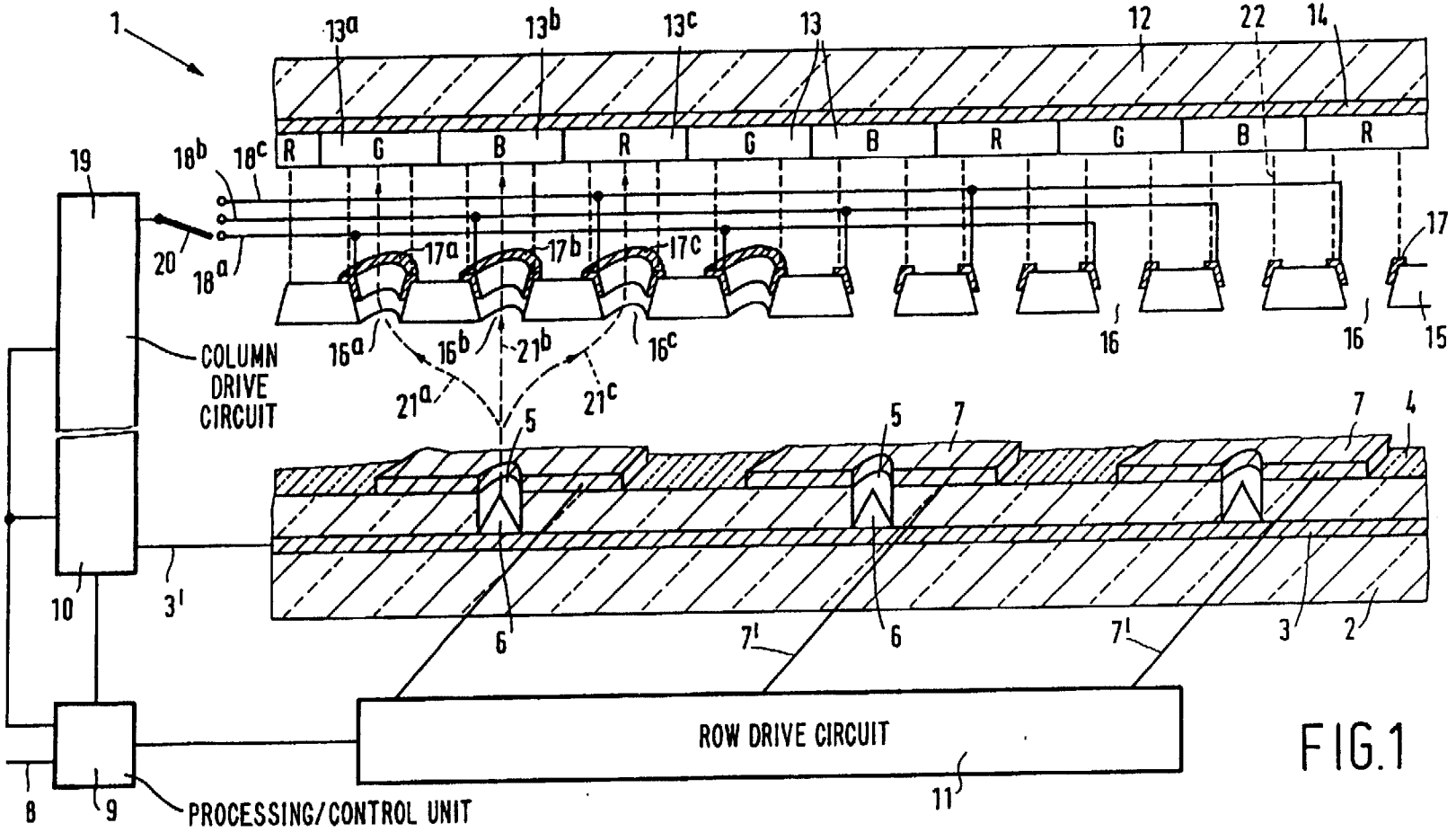
FIG. 1 is a diagrammatic cross-sectional and a partial front elevational view of a part of a display device according to the invention.

FIG. 1 shows diagrammatically a part of a display device 1 in a cross-section and in a partial front elevational view. This display device has a first substrate 2 of, for example glass on which strip-shaped column or data electrodes 3 of, for example molybdenum are provided, across which a layer 4 of insulating material, for example silicon oxide extends. To obtain a uniform emission, a resistance layer may be provided between the electrodes 3 and the field emitters. The layer 4 has apertures 5 in which electron-generating means, in this example field emitters 6, are realised. These field emitters are usually dot-shaped, conical or pointed. Although only a single field emitter 6 is shown as an electron-generating area, such an area usually comprises a large number of these field emitters (100×100). Strip-shaped gate electrodes 7, which function as row or selection electrodes, are present on the layer 4. Incoming information 8 is processed in a processing/control unit 9, if necessary, and then stored in a column drive circuit 10. If a row electrode 7 is selected via the row drive circuit 11, the emission of the associated field emitters 6 is determined by the voltage difference between the electrodes 3 and 7 which in their turn are determined by the contents of the drive circuits 10, 11.

The first substrate 2 faces a second transparent substrate 12 provided with a transparent conducting layer 14 of, for example indium tin oxide which in turn is provided with a layer 13 having a pattern of phosphors (R, G, B) in this example, but also a single phosphor layer (in a monochrome display device) is possible. By giving the electrode 14 (anode) a sufficiently high voltage, electrons emitted by the field emitters are accelerated towards the substrate 12 (the front plate) where they cause a part of the phosphor pattern corresponding to a pixel to luminesce. As described, the quantity of emitted electrons is modulated with voltages applied to the data, electrodes 3 via connections 3'.

A selection plate 15 with apertures 16, which are tapered towards the side of the second substrate 12, is provided between the two substrates 2, 12. At the side of the second substrate, the apertures 16 are provided with metallization patterns 17 which extend across the selection plate 15 and are driven by means of the circuit 19 via connections 18 (shown diagrammatically). If the circuit 19 energizes the connection $18^a$ by means of the switch 20, the metallization pattern $17^a$ is given such a high voltage that the electrons which are generated by the field emitter 6 follow the path $21^a$ and the electrons are passed through the aperture $16^a$ and subsequently impinge upon the phosphor area $13^a$ (the green area in this example). Similarly, electron paths $21^b$, $21^c$ are followed when the connections $18^b$, $18^c$ are energized, so that the electrons impinge upon the phosphor areas $13^b$, $13^c$ (the blue and red areas in this example). Dependent on the acceleration voltages used, the electrons may impinge upon an area between the apertures where they generate secondary electrons which reach the selected aperture by "hopping". If necessary, one or more glass plates (denoted by broken lines 22 in FIG. 1) may be provided between the selection plate 15 and the second substrate, which plates have apertures whose diameter is substantially equal to that of the apertures in the selection plate at the side of the second substrate (post-acceleration spacer). The walls of the apertures of these plates may be coated with an insulating or very high-ohmic coating so that the secondary electron emission coefficient is approximately 1.

Figure 2:
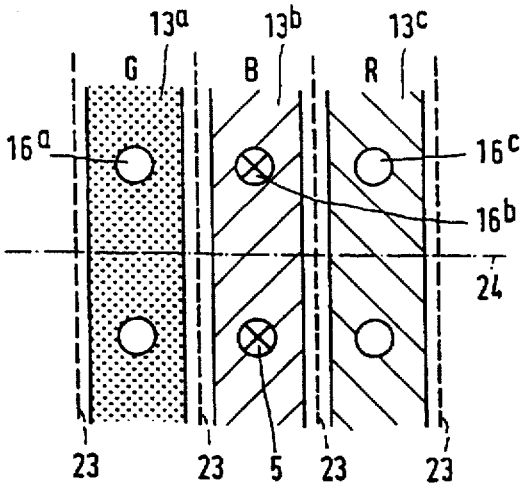
FIG. 2 is a part of a front elevational view.

FIG. 2 is a diagrammatic plan view of a part of the device of FIG. 1. Dependent on the drive described above, electrons from a single emitter 6 (here denoted by means of a cross), which pass through the apertures 16, impinge upon mutually separated strips $13^a$, $13^b$, $13^c$ of phosphors. Since the electrons pass through the apertures 16 (and possibly through apertures in any post-acceleration spacers), they impinge upon the phosphors substantially perpendicularly so that there is hardly any colour contamination. Moreover, higher voltages can be used by using the selection plate 15. The advantage is a larger light output and slower ageing of the phosphors.

The broken lines 23 diagrammatically show the separation between the phosphor strips, i.e. the separation between rows of pixels in the horizontal direction, while the dot-and-dash line 24 diagrammatically shows the separation between pixels of pixels. Since the selection takes place just before the electrons impinge upon the phosphors, a given misregistering of the emitters relative to the phosphor area is allowed; this simplifies the composition of a substrate from a plurality of sub-substrates.

Figure 3:
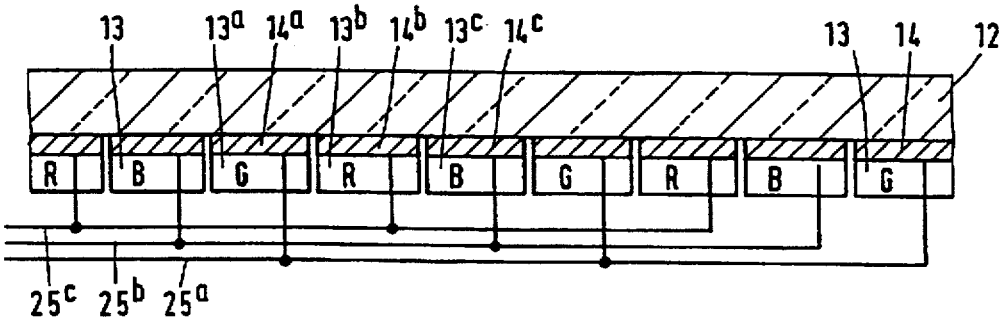
FIG. 3 shows a possible variant of the device of FIG. 1.

FIG. 3 shows a front plate 12 on which the electrode 14 is subdivided into sub-electrodes and on which the selection of phosphor areas, to which the electron paths lead, takes place by selective energization of the sub-electrodes, for example successively $14^a$, $14^b$, $14^c$ by means of the drive lines $25^a$, $25^b$, $25^c$. In this case, phosphor strips $13^a$ (green), $13^b$ (blue), $13^c$ (red) are provided on the sub-electrodes 14. This form of multiplexing may be realised separately, but it may also be used in the device of FIG. 1 in which the lines $18^a$, $18^b$, $18^c$ and the lines $25^a$, $25^b$, $25^c$ are energized synchronously. In this case, the lines 25 are also driven, for example by means of the circuit 19.

Figure 4:
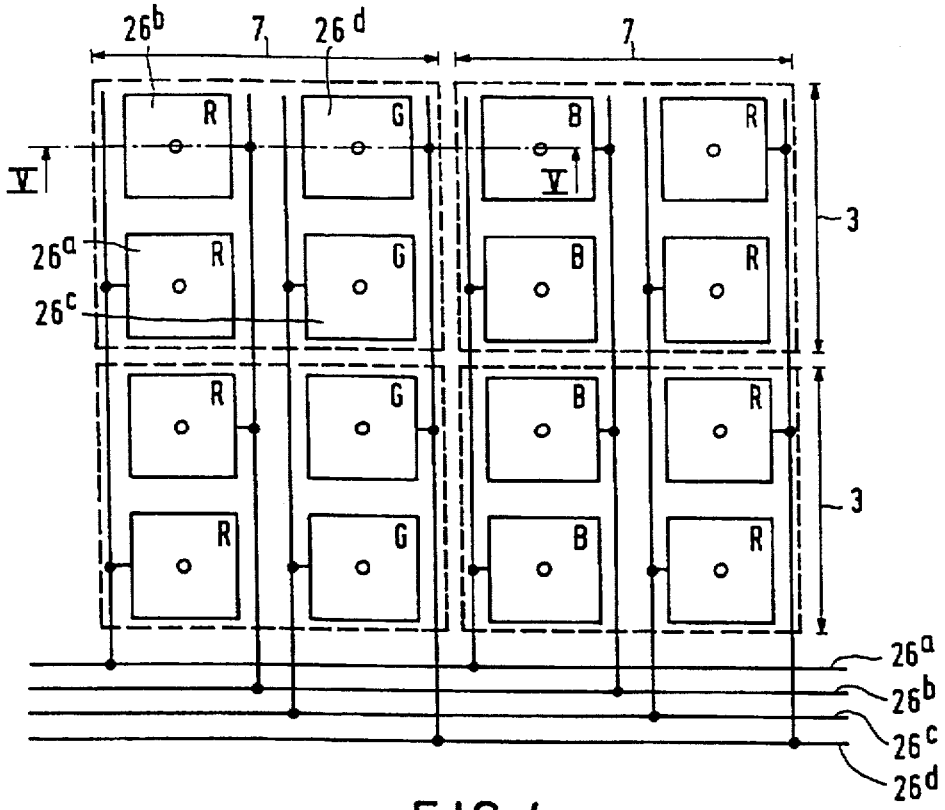
FIG. 4 is a diagrammatic plan view.
Figure 5:
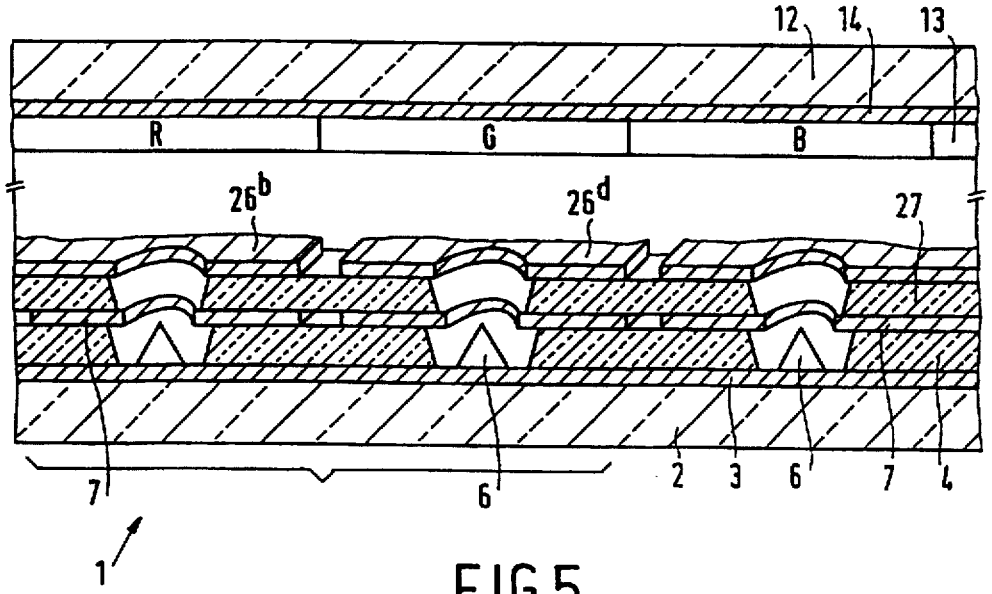
FIG. 5 is a cross-sectional view taken on the line V—V in FIG. 4 and a partial front elevational view of a part of another display device according to the invention.

FIG. 4 is a diagrammatic plan view and FIG. 5 is a cross-section taken on the line V—V in FIG. 4 of a device according to the invention, in which multiplexing takes place by means of multiplexing electrodes 26 on the substrate 2. At the location of a crossing of a row electrode 7 and a column electrode 3, a plurality of electron-generating areas is present, in this example single field emitters 6 whose emission is determined by the voltage difference between the electrodes 3, 7; the electrodes 3 may also operate as row or selection electrodes, with information signals being applied to the electrodes 7 which then function as data or column electrodes. If the voltages at the multiplexing electrodes 26 are sufficiently low, for example lower than those at the row electrode (gate electrode) 7, the emitted electrons are drained towards these electrodes 26. By selection of one of the groups of electrodes $26^a$, $26^b$, $26^c$, $26^d$ by means of a voltage which is higher than that at the column electrode (gate electrode) 7, the emitted electrons are directed towards the phosphor areas 13. Possible selection plates and post-acceleration spacers are not shown in FIG. 5. Otherwise, the reference numerals in FIG. 5 denote the same parts as those in FIG. 1. The total image is imaged in this example by means of four sub-images which are consecutively selected and imaged via the electrodes $26^a$, $26^b$, $26^c$, $26^d$. The sub-images comprise substantially equal quantities of red, green and blue pixels, with the weighted composition of the sub-images defining the ultimate colour. A delta-nabla configuration may also be realised with a slightly different geometry of the phosphor elements.

Figure 6:
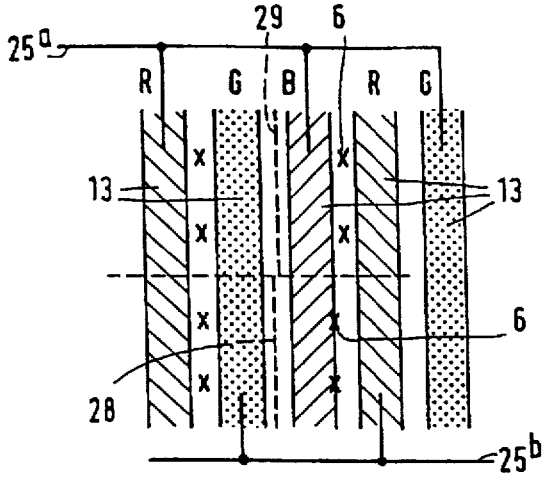

Notably in the device of FIG. 1 or FIG. 3, the phosphors 13 can be provided in a different manner with respect to the electron-generating areas. A first possibility is shown in FIG. 6, in which the phosphors are implemented as strip-shaped patterns 13, which are selectively driven via drive lines 25. The emitters 6 (denoted by crosses) are always situated between two strips 13, viewed transversely to the substrates. Emitted electrons are alternately accelerated to the one or the other strip by means of a control circuit which is analogous to that of FIG. 1. The total image within a picture period is obtained by first selecting information (selected in the correct manner) for half an image, for example for red, green and blue during half a picture period, and by accelerating electron currents modulated by said information to one half of the phosphor strips by energizing drive line $25^a$, and subsequently by selecting information for the other half image during the second half of the picture period and by accelerating electron currents modulated by said information towards the one half of the phosphor strips by energizing drive line $25^b$.

Figure 7:
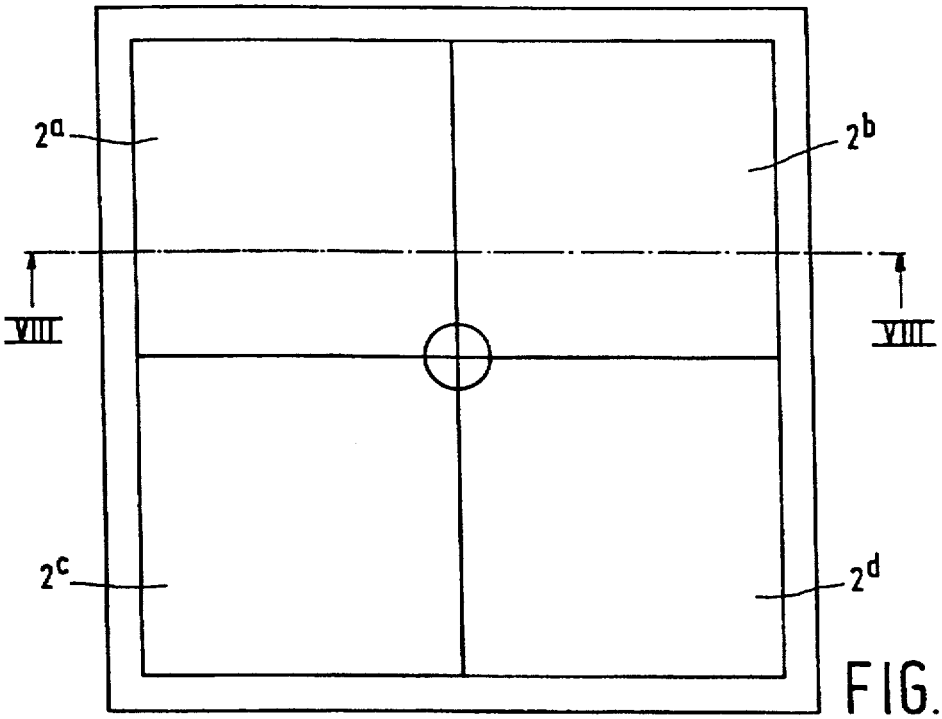
Figure 8:
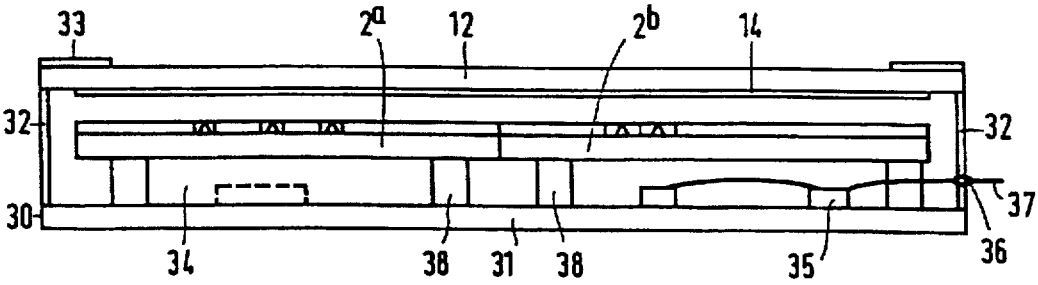
FIG. 8 is a cross-sectional view taken on the line VIII—VIII in FIG. 7.

If a display device comprises a plurality of sub-substrates 2, as shown in FIGS. 6, 7 and 8, a partial misregistering of the sub-substrates is allowed in this configuration. For example, since the sub-substrates $2^c$ and $2^d$, separated by the broken line 28, are slightly offset in the centre with respect to the sub-substrates $2^a$ and $2^b$, separated by the broken line 29, the emitters 6 on the sub-substrate $2^d$ are not situated between the strips 13, as seen in a plan view in this example. Since the destination of the electrons is now actually determined by the drive on the second substrate 12 (or the post-acceleration plate), such a misregistering is not troublesome. The complete construction is accommodated in a housing 30 with a rear plate 31 and side walls 32. The substrates 2 are spaced apart by means of supporting elements or spacers 38. The entire space bounded by the rear plate 31, the side walls 32 and the second substrate 12 is vacuum-exhausted or has a very low pressure. The space between the rear plate 31 and the substrates 2 may advantageously accommodate a getter 34 (shown diagrammatically), as well as drive electronics 35 which are connected to external connections 37 via lead-throughs 36.

Figure 9:
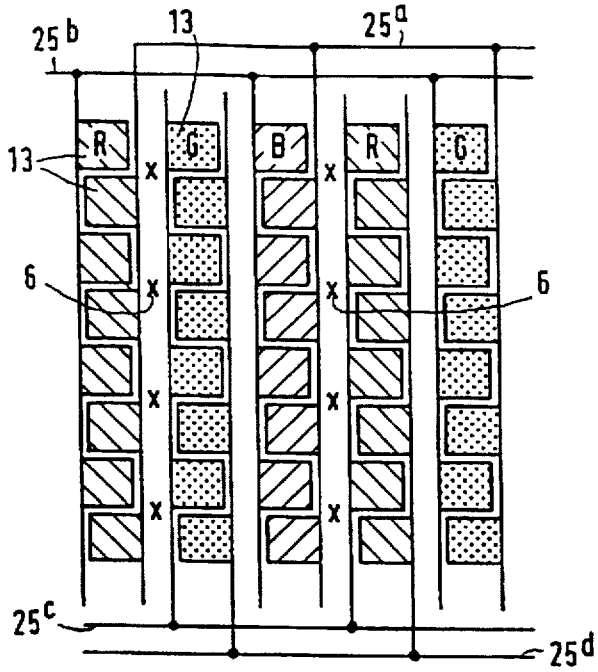
FIGS. 9 to 12 show possible phosphor patterns.

The phosphors on the second substrate need not necessarily be provided as strips. FIG. 9 shows a variant in which the strips are subdivided into separate (square) colour areas of one and the same colour which are alternately connected to two different drive lines $25^a$ and $25^b$, and $25^c$ and $25^d$, respectively, during a quarter of a picture period. Similarly as described with reference to FIG. 5, the total image is now obtained by first selecting information (selected in the correct manner) for a quarter of the image for red, green and blue and by energizing drive line $25^a$ so that electron currents modulated by said information are accelerated towards a quarter of the phosphor areas, and by subsequently selecting information for the next quarter of the image and accelerating electron currents modulated by said information towards a subsequent quarter of the phosphor areas by energizing drive line $25^b$ etc. Four different phosphor areas now have one emitter 6 in common; in this way, not only a larger positioning tolerance of the first substrate with respect to the second substrate is obtained, but the number of connections is also reduced drastically.

Figure 10:
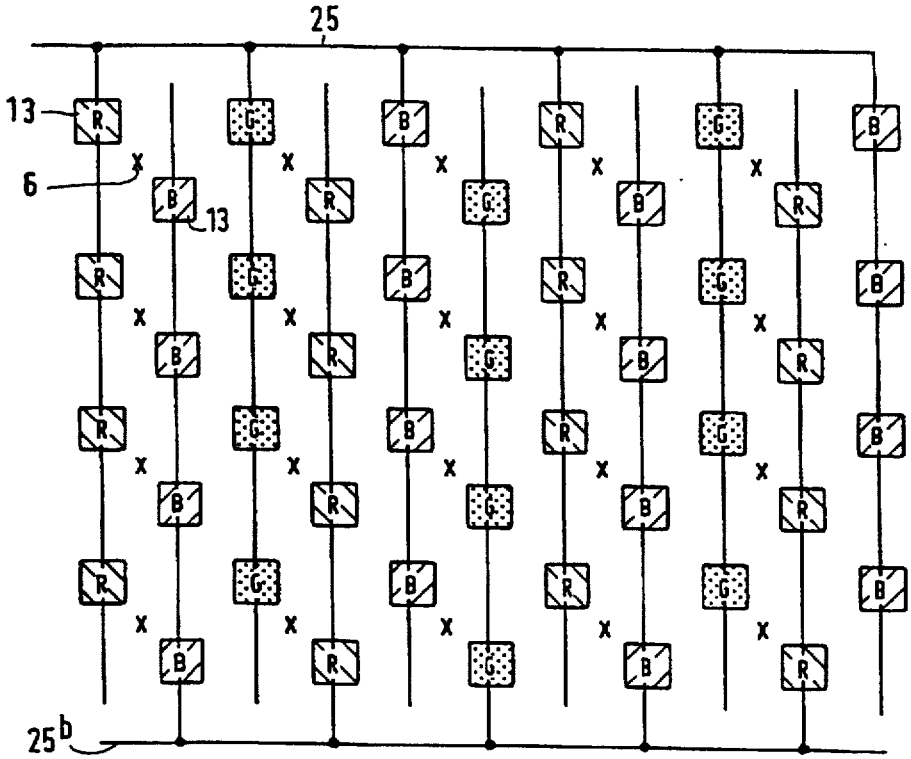

FIG. 10 shows a mixed form of FIGS. 2 and 9, in which the phosphors are provided as groups arranged in rows but are each time offset by half a pitch (delta-nabla configuration). The drive (two phosphor groups 13 per emitter 6, hence two sub-images) is analogous to that described with reference to FIG. 5.

Figure 11:
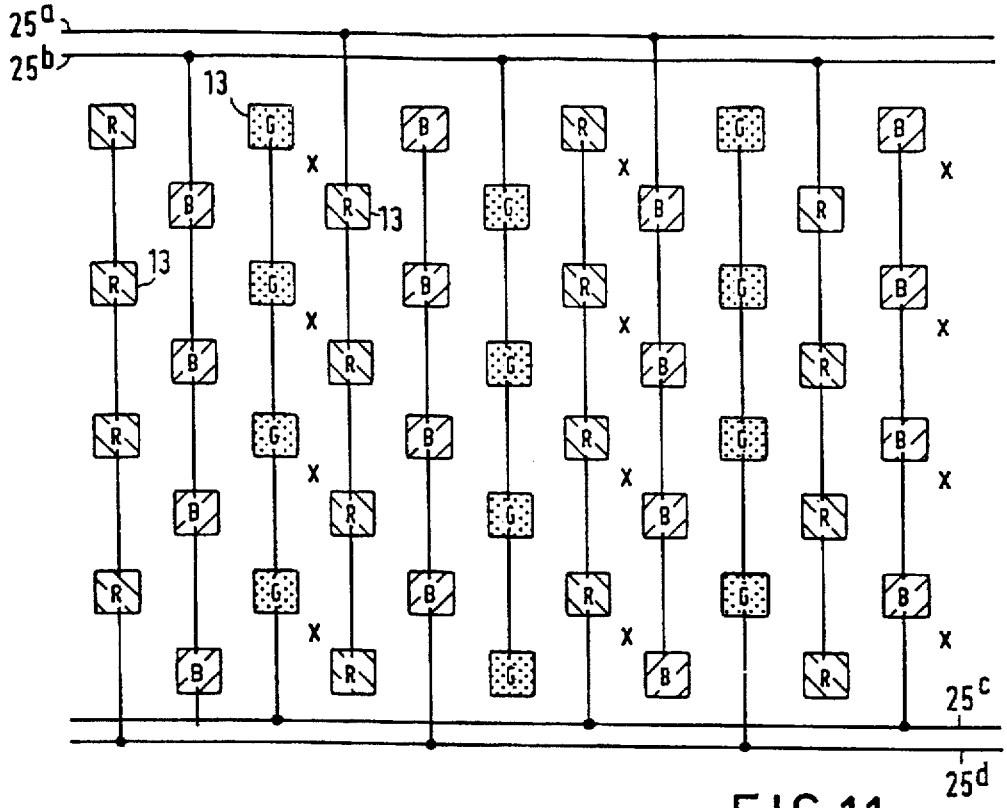

FIG. 11 shows a similar delta-nabla configuration, but this time with four phosphor groups 13 per emitter 6; the drive mode can be compared with that of FIG. 9.

Figure 12:
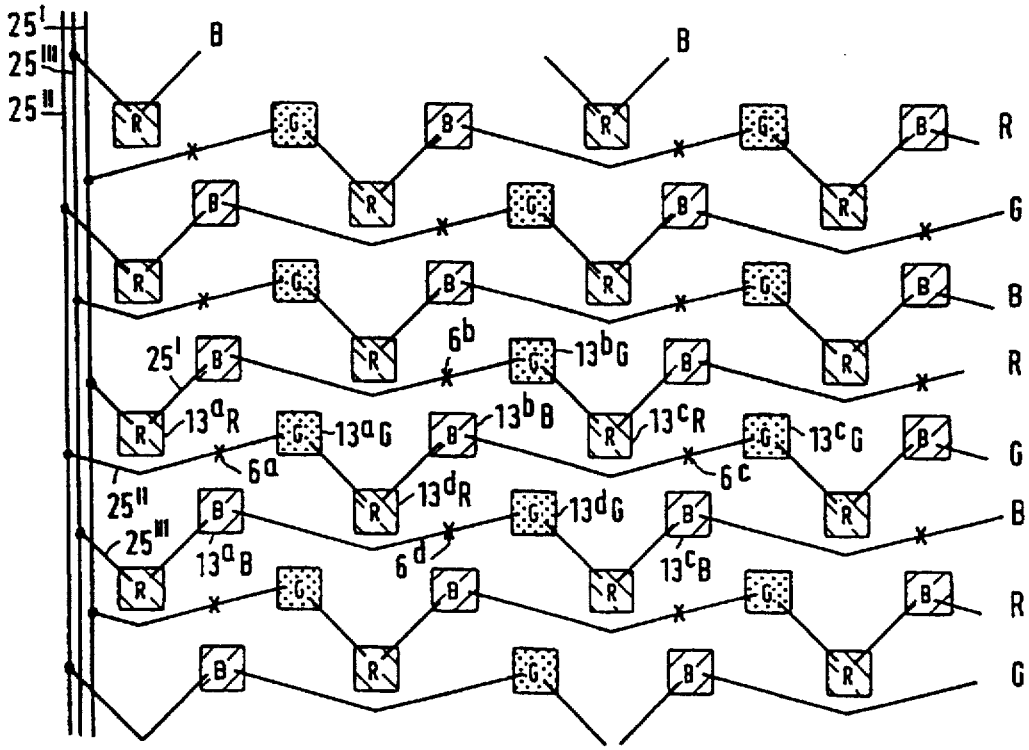

Finally, FIG. 12 shows a configuration in which each time one of a red, a green and a blue phosphor element of a triplet is energized. An electron-generating area or emitter 6 provides the electron current for the three adjacent phosphor elements, dependent on the drive. It is adapted to be such that when, for example line 25' is activated, emitter $6^a$ emits in conformity with the information for phosphor element $13^a$R, emitter $6^b$ emits in conformity with the information for phosphor element $13^b$B and emitter $6^c$ emits in conformity with the information for phosphor element $13^c$R, and so forth. When line 25" is activated, emitter $6^a$ emits in conformity with the information for phosphor element $13^a$G, emitter $6^b$ emits in conformity with the information for phosphor element $13^b$B, emitter $6^d$ emits in conformity with the information for phosphor element $13^d$R and emitter $6^c$ emits in conformity with the information for phosphor element $13^c$G; when line 25'" is activated, emitter $6^a$ emits in conformity with the information for phosphor element $13^a$B, emitter $6^d$ emits in conformity with the information for phosphor element $13^d$G and emitter $6^c$ emits in conformity with the information for phosphor element $13^b$B, and so forth.

The invention is of course not limited to the examples shown, but many variations are possible within the scope of the invention. For example, the additional acceleration electrodes 26 in FIG. 5 may also be implemented as configurations, similar to the configurations shown in FIGS. 6 and 9 to 10.

As already noted in the opening paragraph, a diamond emitter which is provided on the electrodes 3 may be used alternatively. Selection and electron emission are again determined by voltages at the electrodes 3, 7 and 20, similarly as described with reference to FIGS. 1, 4 and 5. Post-acceleration takes place by means of a potential difference between the electrodes 7 (20) and the phosphor screen. The diamond emitter may be provided after the electrodes 3 have been structured, by providing a diamond coating, but also after the apertures 5 have been formed at the location of the crossing metal tracks. In the latter case, passivation of the diamond layer (outside the apertures 5) is necessary so as to prevent unwanted emission of diamond present on the insulation layer 4 to the phosphor screen. This may be realised, for example by deposition of an extra layer of insulating material at such an angle that the insulating material is not deposited on the bottoms of the apertures.

In summary, the invention provides the possibility of combining a plurality of sub-substrates that are attached to a larger rear wall because notably different modes of multiplexing provide a wider positioning tolerance of a sub-substrate with respect to the front plate. Moreover, the different multiplexing techniques lead to a smaller number of connections, even when no use is made of a rear wall supporting sub-substrates. A plurality of multiplexing techniques provides the possibility of activating a substantially equally large quantity of pixels of different colours during parts of a picture period, so that there is substantially no colour flicker.

We claim:

1. A display device comprising a first substrate means which is provided with means for generating and means for modulating electron beams and a second substrate means which is parallel to the first substrate means and is provided with fluorescent means disposed in a predefined area for producing an image in response to impingement by the electron beams;

said first substrate means comprising a plurality of adjacent sub-substrates, each of the sub-substrates being approximately arranged opposite a corresponding sub-area of the predefined area, and each of said sub-substrates generating a plurality of the electron beams;

said display device comprising multiplexing means for successively, selectively enabling different groups of the electron beams to impinge on the fluorescent means, each of said groups including electron beams from each one of said plurality of the sub-substrates, the electron beams from any particular sub-substrate being directed toward the corresponding sub-area opposite thereto.

2. A display device as in claim 1 where the first substrate means includes a first side facing the second substrate means and a second side remote from the first side and facing away from the second substrate means, said display device further including a rear plate spaced apart from the second side of the first substrate means, thereby defining a space between the second side and the plate.

3. A display device as in claim 2, characterized in that a getter is accommodated in the space between the second side of the first substrate means and the rear plate.

4. A display device as in claim 1 where the multiplexing means comprises a multiplicity of electrodes having respective apertures for passing the electron beams.

5. A display device as in claim 1 where the multiplexing means comprises groups of electrodes, the electrodes in each group being mutually electrically connected and having apertures for passing a corresponding group of the electron beams.

6. A display device as in claim 4 or 5 where the electrodes are disposed on the first substrate means.

7. A display device as in claim 1 wherein said plurality of adjacent sub-substrates are substantially coplanar.

8. A display device comprising a first substrate means which is provided with means for generating and means for modulating electron beams and a second substrate means which is parallel to the first substrate means and is provided with a fluorescent layer disposed in a predefined area for producing an image in response to impingement by the electron beams on the fluorescent layer;

said first substrate means comprising a plurality of adjacent substantially coplanar sub-substrates, each of the sub-substrates being approximately arranged opposite a corresponding sub-area of the fluorescent layer, and each of said sub-substrates generating a plurality of the electron beams for impingement upon the sub-area of the fluorescent layer corresponding thereto;

said first substrate means including a first side facing the second substrate means and a second side remote from the first side and facing away from the second substrate means, said display device further including a rear plate spaced apart from the second side of the first substrate means, thereby defining a space between the second side and the plate.

9. A display device as in claim 8, characterized in that a getter is accommodated in the space between the second side of the first substrate means and the rear plate.

* * * * *